US009585807B2

(12) United States Patent
Fellingham et al.

(10) Patent No.: US 9,585,807 B2
(45) Date of Patent: Mar. 7, 2017

(54) COLLAPSIBLE UPRIGHT WHEELED WALKER APPARATUS

(71) Applicant: Protostar, Inc., San Diego, CA (US)

(72) Inventors: Peter James Fellingham, San Diego, CA (US); Yichuan Pan, San Diego, CA (US); David A Purcell, San Diego, CA (US); Nebojsa Sataric, Krusevac (RS)

(73) Assignee: Protostar, Inc., a Delaware Corporation, San Diego, CA (US)

( * ) Notice: Subject to any disclaimer, the term of this patent is extended or adjusted under 35 U.S.C. 154(b) by 0 days.

(21) Appl. No.: 15/148,993

(22) Filed: May 6, 2016

(65) Prior Publication Data

US 2016/0331626 A1 Nov. 17, 2016

Related U.S. Application Data

(60) Provisional application No. 62/215,656, filed on Sep. 8, 2015, provisional application No. 62/162,706, filed on May 16, 2015.

(51) Int. Cl.

| | |
|---|---|
| ***B62B 9/12*** | (2006.01) |
| ***A61H 3/04*** | (2006.01) |
| *A61H 3/00* | (2006.01) |

(52) U.S. Cl.

CPC ..... *A61H 3/04* (2013.01); *A61H 2003/006* (2013.01)

(58) Field of Classification Search

CPC ..... A61H 2003/006; A61H 2003/046
USPC ..... 280/87.021, 87.05; 135/67, 75
See application file for complete search history.

(56) References Cited

U.S. PATENT DOCUMENTS

| | | | | |
|---|---|---|---|---|
| 3,394,933 | A * | 7/1968 | Benoit | A61G 7/1019 254/4 R |
| 4,510,956 | A * | 4/1985 | King | A61H 3/04 135/67 |
| 4,907,794 | A | 3/1990 | Rose | |
| 5,020,560 | A * | 6/1991 | Turbeville | A61H 3/04 135/67 |
| 5,636,651 | A | 6/1997 | Einbinder | |
| 5,657,783 | A | 8/1997 | Sisko et al. | |

(Continued)

OTHER PUBLICATIONS

Manton, et al., "Changes in the Use of Personal Assistance and Special Equipment from 1982 to 1989: Results from the 1982 and 1989 NLTCS," Gerontologist 33(2)168-76 (Apr. 1993).

(Continued)

*Primary Examiner* — Jeffrey J Restifo
(74) *Attorney, Agent, or Firm* — James Albert Ward

(57) ABSTRACT

A collapsible upright wheeled walker with adjustable armrests that support sufficient user upper-body weight to facilitate a natural upright gait and provide unassisted mobility for a wide range of mobility-impaired individuals. The apparatus may be easily and quickly folded (and unfolded) and may include bilateral stabilizing wheel suspensions to facilitate navigation over uneven terrain. The apparatus includes a frame-stiffening folder assembly and may also include mechanical brakes, an adjustable upper armrest assembly with removable padded forearm supports and two pairs of handles, at least one of which is disposed sufficiently forward to place the user within the polygonal footprint defined by the front and rear wheels to provide support without leaning, stooping, or risking falls.

7 Claims, 14 Drawing Sheets

(56) References Cited

U.S. PATENT DOCUMENTS 5,676,388 A * 10/1997 Bertani ..... A61H 3/04 280/250.1
5,702,326 A * 12/1997 Renteria ..... A61H 3/04 135/67
6,099,002 A * 8/2000 Uchiyama ..... A61H 3/04 135/67
6,733,018 B2 * 5/2004 Razon ..... A61H 3/008 135/67
6,886,575 B2 5/2005 Diamond
6,974,142 B1 * 12/2005 Shikinami ..... A61H 3/04 280/250.1
7,001,313 B1 2/2006 Crnkovich
7,052,030 B2 5/2006 Serhan
7,111,856 B1 * 9/2006 Graham ..... A61H 3/04 135/67
7,275,554 B2 * 10/2007 Mullholand ..... A61H 3/008 135/67
D561,065 S 2/2008 Kindberg et al.
7,377,285 B2 * 5/2008 Karasin ..... A61H 3/04 135/66
7,494,138 B2 * 2/2009 Graham ..... A61G 5/08 280/304.5
7,497,449 B2 3/2009 Logger
7,559,560 B2 7/2009 Li et al.
7,568,712 B2 * 8/2009 Kovachi ..... A61H 3/008 280/23.1
7,669,863 B2 * 3/2010 Steiner ..... A61G 5/14 280/250.1
7,708,120 B2 5/2010 Einbinder
7,866,677 B1 * 1/2011 Rothstein ..... A61H 3/04 135/67
7,992,584 B1 * 8/2011 Birnbaum ..... A61H 3/04 135/67
8,100,415 B2 1/2012 Kindberg et al.
8,151,812 B2 * 4/2012 Razon ..... A61H 3/04 135/66
8,166,987 B2 5/2012 Weaver
8,215,652 B2 * 7/2012 Dashew ..... A61H 3/04 135/67
8,468,622 B2 * 6/2013 Purwar ..... A61G 7/1017 297/5
8,540,256 B1 * 9/2013 Simpson ..... A61H 3/00 135/67
8,678,425 B2 3/2014 Schaaper et al.
8,740,242 B2 * 6/2014 Slomp ..... B26B 3/02 135/67
8,770,212 B2 * 7/2014 Alghazi ..... A61G 7/10 135/66
8,783,700 B2 7/2014 Li
8,794,252 B2 8/2014 Alghazi
8,840,124 B2 9/2014 Serhan et al.
8,936,033 B2 1/2015 Velarde
8,998,223 B2 4/2015 Chang
9,016,297 B2 * 4/2015 Salomon ..... A45B 1/02 135/66
9,149,408 B2 * 10/2015 Karlovich ..... A63B 69/0064
9,173,802 B2 11/2015 Willis
9,180,066 B2 * 11/2015 Izard ..... A61H 3/008
9,221,433 B2 12/2015 Dunlap
9,289,347 B2 * 3/2016 Powell ..... A61H 3/04
9,314,395 B1 * 4/2016 VanAusdall ..... A61H 3/04
2003/0137119 A1 * 7/2003 Razon ..... A61H 3/008 280/87.021
2005/0156395 A1 * 7/2005 Bohn ..... A61H 3/04 280/87.021
2009/0224499 A1 * 9/2009 Dashew ..... A61H 3/04 280/87.05
2013/0319488 A1 * 12/2013 Chiu ..... A61H 3/00 135/67
2015/0216757 A1 * 8/2015 Powell ..... A61H 3/04 280/657

OTHER PUBLICATIONS

Laplante et al., "Demographics and Trends in Wheeled Mobility Equipment Use and Accessibility in the Community," Assistive Technology, 22, 3-17, (2010).
Martins et al., Assistive Mobility Devices focusing on Smart Walkers: Classification and Review, Robotics and Autonomous Systems 60 (4), Apr. 2012, pp. 548-562.

* cited by examiner 170A
170B
126A
100
126B
124B
124A
172A
146
138
172B
120A
120B
174A
144
136
174B
108A
108B
102
150
127
130
160
128
162
152
148
166
156
134
132
164
154
106A
106B

COLLAPSIBLE UPRIGHT WHEELED WALKER APPARATUS

CROSS-REFERENCES TO RELATED APPLICATIONS

This application is filed under 35 U.S.C. 111(a) pursuant to 37 C.F.R. 1.53(b) claiming the benefit under 35 U.S.C. §119(e) of U.S. Patent Application No. 62/162,706 filed on May 16, 2015 and entirely incorporated herein by reference and also claiming the benefit under 35 U.S.C. §119(e) of U.S. Patent Application No. 62/215,656 filed on Sep. 8, 2015 and entirely incorporated herein by reference.

This application is related by common inventorship and subject matter to the commonly-assigned U.S. patent application Ser. No. 15/012,784 filed on Feb. 1, 2016, which is entirely incorporated herein by reference.

BACKGROUND OF THE INVENTION

1. Field of the Invention

This invention relates generally to assistive mobility devices and more particularly to a collapsible upright wheeled weight-bearing walker.

2. Description of the Related Art

Assistive mobility devices, including walkers, are well-known in the art as useful means for reducing the disadvantages of mobility impairment suffered for many different reasons by many people, permitting more efficient ambulation over distance and thereby increased independence. Data from the National Long Term Care Survey suggests that increased use of assistive technology may have helped reduce disability at older ages [Manton, et al., "Changes in the Use of Personal Assistance and Special Equipment from 1982 to 1989: Results from the 1982 and 1989 NLTCS," *Gerontologist* 33(2):168-76 (April 1993)]. Although mobility device users represent a relatively small minority of the population with disabilities, their importance transcends their numbers because mobility devices are visible signs of disability and have become symbols of the very idea of disability. And the mobility-impaired population is increasing much faster than the general population [LaPlante et al., "Demographics and Trends in Wheeled Mobility Equipment Use and Accessibility in the Community," *Assistive Technology,* 22, 3-17, (2010)]. Accordingly, there has long been a growing demand for improved mobility assistance devices adaptable for improving ambulation for mobility-limited persons.

Martins et al. [Martins et al., Assistive Mobility Devices focusing on Smart Walkers: Classification and Review, *Robotics and Autonomous Systems* 60 (4), April 2012, pp. 548-562] classifies mobility assistance devices into the alternative devices intended for those with total loss of independent mobility (wheelchairs or autonomous powered vehicles) and assistive or augmentative devices for those with residual mobility capacity (prostheses, crutches, canes and walkers). For several reasons, most impaired individuals prefer to avoid association with the alternative devices associated with total incapacity. Similarly, the rehabilitation profession strongly prefers the assistive devices, which can be used for physical therapy and as mobility-training devices. Accordingly, there has long been a growing demand for improved assistive devices adapted for use by the less disabled among those who otherwise cannot move independently with existing assistive devices and rely on alternative devices such as wheelchairs and powered scooters.

Mobility and manipulation are critical to living independently and are often strongly associated with the ability to continue to live safely in one's home. Simple assistive devices such as crutches, canes, walkers, and rollators (rolling walkers) can assist a person who has the endurance and strength to walk distances, but these devices must also provide some support or feedback to keep the person from losing their balance or enable the person to rest, when necessary. Although an impaired individual may eventually need an alternative device like a wheelchair or powered scooter, most strongly desire to retain the independence of the simpler assistive device for as long as possible. For this reason, there is a well-known and long-felt need for assistive device improvements that facilitate independent ambulation for the progressively more impaired individuals.

Although popular, the most common assistive devices known in the art (canes, walkers and rollators) have many well-known disadvantages; even for the relatively mobile individual.

The typical wheeled walker known in the art has many well-known disadvantages; such as requiring a stooping or a forward leaning posture to avoid a hobbled gait, difficulty in smooth transition over irregular terrain, little or no upper body and arm support, and requiring significant hand and arm strength to maneuver and to operate any available hand brake, for example. A stooping posture stresses the user's back and arms and risks tipping forward when encountering terrain obstacles. And most devices known in the art have no wheels or wheels too small to negotiate even small surface irregularities safely. Some devices are too heavy and awkward for an unassisted user to lift into a car trunk or van, which limits independent unassisted use. Walker brakes are often either nonexistent or ineffective for the unassisted impaired user, which adds risk of falls and injury and limits independence.

The typical wheeled walker known in the art is neither designed nor intended to support significant user weight during use. As with a cane, the accepted purpose of a wheeled walker is simply to provide assistance in balance and gait, like an elaborate cane system. So the user engages the walker with hands and wrists alone, often with a stooping or leaning posture. The impaired user generally lacks the hand and wrist strength needed to continuously support significant upper body weight while walking in a stooped or forward-leaning position. Some wheeled walkers eliminate the seat to afford a more open walking footprint for the user. While this permits an improved and more natural walking position but offers no improved weight bearing capability and many users need an included seat to facilitate independent use over longer distances.

The mobility assistance art is replete with suggestions for improving wheeled walkers.

For example, in U.S. Pat. No. 8,100,415, Kindberg et al. disclose a wheel suspension that facilitates curb climbing when used with large wheels in, for example, a rollator. But Kindberg et al. limit their teachings to negotiating uneven terrain such as curbs. In U.S. Pat. No. D561,065, Kindberg et al. also disclose a walker frame design.

And, for example, in U.S. Pat. No. 8,840,124, Serhan et al. disclose a safety brake in a rollator that improves the safety of seated users by using a braking system that locks the rollator wheels when the user sits down on the rollator seat, and releases the wheels when the user stands up. As another example, in U.S. Pat. No. 7,052,030, Serhan discloses a wheeled walker with cross-member supports adapted to permit both seat and basket with wheel sizes greater than seven to eight inches. In U.S. Pat. No. 6,886, 575, Diamond discloses a locking assembly for use with a walker having foldable side members. And, for example, in U.S. Pat. No. 8,678,425, Schaaper et al. disclose a wheelchair having a moveable seat element facilitating use as a rollator.

In U.S. Pat. No. 8,740,242, Slomp discloses a posterior walker configured to encourage a neutral spine during use. And, for example, in U.S. Pat. No. 7,559,560, Li et al. discloses a rollator having a foldable seat element.

Some practitioners propose improving the walker mobility aid by adding upper support means for supporting the user's forearms, hands or shoulders to improve user comfort and posture. For example, in U.S. Pat. No. 5,657,783, Sisko et al. disclose accessory forearm rests that may be mounted to any conventional invalid walker, preferably disposed above the normal hand-grips to provide support for the user's arms.

Such an upright wheeled walker may permit the user to walk upright but the wheeled walker known in the art is not adapted to support any user body weight beyond the relatively small portion in the forearms and hands. For example, in U.S. Pat. No. 8,540,256, Simpson discloses a walker with a forearm support frame to permit an upright user to step forward with the walker footprint but little weight bearing capacity. Similarly, in U.S. Pat. No. 8,740,242, Slomp discloses a foldable posterior walker with an anteriorly open frame that permits an upright user to step forward within the walker footprint but having little or no weight bearing capability.

Improving a the wheeled walker by adding an upper-body support is advantageous because it facilitates an upright walking and standing posture, improved gait and comfort. But adding significant user body weight to the wheeled walker is also disadvantageous for stability. The increased weight borne on each wheel affects walker stability, braking, and terrain handling. For example, adding significant upright weight support to the wheeled walker introduces new disadvantages of increased lateral and longitudinal instability, risking falls and affecting user safety. Adding more weight support at a higher point on the walker increases the tipping torque at the wheels because of the increased force and distance. Any wheeled walker has longitudinal stability problems when rolling on slopes and over irregular terrain, which may imperil user safety by causing falls during use. This longitudinal instability problem is exacerbated by the fluctuating wheel loads imposed by the applied user weight during stepping, introducing a new lateral instability.

Several practitioners suggest improvements to mitigate the wheeled walker longitudinal stability problem with braking system improvements. For example, in U.S. Pat. No. 8,998,223. Chang discloses a wheel braking system for a rollator with a "dead-man brake" whereby the wheels are halted upon the release of the user's hands from the handles, improving user safety on slopes. Similarly, in U.S. Pat. No. 9,221,433, Dunlap discloses a safety braking system for a rollator that includes a park mode, a walk mode and a brake mode with a handlebar control mechanism.

Recognizing these new instability problems, practitioners have suggested turning to a powered vehicle to permit some user weight support in assistive devices. For example, in U.S. Pat. No. 8,794,252, Alghazi discloses a mobility apparatus with an integrated power source and four wheels so a user can stand on it and drive it as an electric mobility device, or disable it and use it as a passive walker. His device is collapsible and includes a pair of supporting beams disposed to support the user under the armpits, but such support does little to improve user posture or stability while walking with the passive device. And, in U.S. Pat. No. 8,234,009, Kitahama discloses an autonomous mobile apparatus that moves autonomously along near a specified person (user) while detecting and evaluating the surroundings to assess the danger level to the user, moving as necessary to avoid danger to the user based on the danger level detected.

Others have proposed elaborate powered control systems to address these stability and other user safety problems. For example, in U.S. Pat. No. 7,708,120, Einbinder discloses an improvement to user safety consisting of a walker braking system using a controller and electrically actuated wheel brakes to provide push-button user control over braking and processor-controlled braking responsive to, for example, user hand position and the terrain slope.

But such devices may be generally perceived by users as alternative devices (such as powered wheel chairs, stair climbers and vehicles) and do not represent the improved assistive device sought by most users.

These and other examples of the mobility assistance art demonstrate that there is a continuing long-felt need for improved solutions to the walking posture, seating, weight support and portability problems discussed above.

These unresolved problems and deficiencies are clearly felt in the art and are solved by this invention in the manner described below.

SUMMARY OF THE INVENTION

This invention solves the well-known walking posture, instability and portability problems described above in a single apparatus by integrating for the first time folding improvements that stabilize the walker frame during use, adjustable forearm rests (for upper body support), an open rigidized frame permitting the user to stand and step within a polygonal footprint defined by the front and rear wheels, and adjustable handles elevated to permit the upright walking posture necessary for better health. The following description and drawing disclose for the first time how these advantageous features may be implemented in a single collapsible wheeled walker.

It is a purpose of this invention to provide many adjustable features to facilitate unassisted mobility for a wide range of mobility-impaired individuals.

It is an advantage of the apparatus of this invention that lightweight construction materials such as aluminum may be employed to reduce weight, thereby facilitating unassisted handling by a mobility-impaired person.

It is an advantage of the apparatus of this invention that the upper arm support elements are each disposed at an ergonometric angle to facilitate a completely upright walking position with substantial upper body and arm support while walking within the polygonal footprint defined by the front and rear wheels.

It is an advantage of the apparatus of this invention that facilitating an upright walking posture reduces heart and lung compression, improves circulation, thereby promoting the therapeutic effects of longer walking times after surgery and may ease recovery from injury.

It is a feature of the apparatus of this invention that it may include two pairs of adjustable grips to provide a lower lateral pair for unsupported handling and an upper vertical pair with small short-throw brake levers disposed to facilitate easy braking operation by a user with arthritic hands.

It is an advantage of the apparatus of this invention that the average-sized user, when gripping the upper pair of handles, is standing such that their hips are disposed substantially entirely forward of the line defined by the rear wheel axles.

It is a feature of the apparatus of this invention that it may include dual-shoe adjustable cable-operated wheel brakes to reduce the grip strength required for the unassisted user to safely brake the apparatus.

In an exemplary embodiment, the apparatus of this invention is a collapsible upright wheeled walker apparatus for augmenting an upright partially-supported walking gait on a walking surface for an unassisted user having one or more hands and forearms, comprising: a frame having two frame sides each having a top and a bottom and each frame side being disposed between a front frame portion and a rear frame portion; a plurality of wheel assemblies coupled to the frame for supporting the frame above the walking surface and disposed at the vertices of a polygonal footprint on the walking surface within which the user walks during use; an X-folder apparatus including an anterior element having two ends and a posterior element having two ends, wherein the anterior element is rotatably coupled to the posterior element, a first anterior element end is coupled to a first frame side and the second anterior element end is rotatably coupled to an anterior arm having a distal end that is coupled to the second frame side such that rotation of the anterior element in one direction with respect to the anterior arm is limited to an anterior over-center angle; and a first posterior element end is coupled to the second frame side and the second posterior element end is rotatably coupled to a posterior arm having a distal end that is coupled to the first frame side such that rotation of the posterior element in one direction with respect to the posterior arm is limited to a posterior over-center angle; two upper supports each coupled to and disposed at an adjustable height above a respective frame side; two forearm gutters each coupled to a respective upper support for engaging and supporting one user forearm during use, wherein each forearm gutter has a centerline disposed at a first gutter angle with respect to the walking surface and at a second gutter angle with respect to the other forearm gutter centerline; and two upper handles each coupled to a respective upper support anterior to the respective armrest gutter for gripping by one user hand, wherein each upper handle has a centerline disposed at a forward handle angle with respect to the respective forearm gutter centerline.

The foregoing, together with other objects, features and advantages of this invention can be better appreciated with reference to the following specification, claims and the accompanying drawing.

BRIEF DESCRIPTION OF THE DRAWINGS

For a more complete understanding of this invention, reference is now made to the following detailed description of the embodiments as illustrated in the accompanying drawing, in which like reference designations represent like features throughout the several views and wherein.

DETAILED DESCRIPTION OF THE EMBODIMENTS

Figure 1:
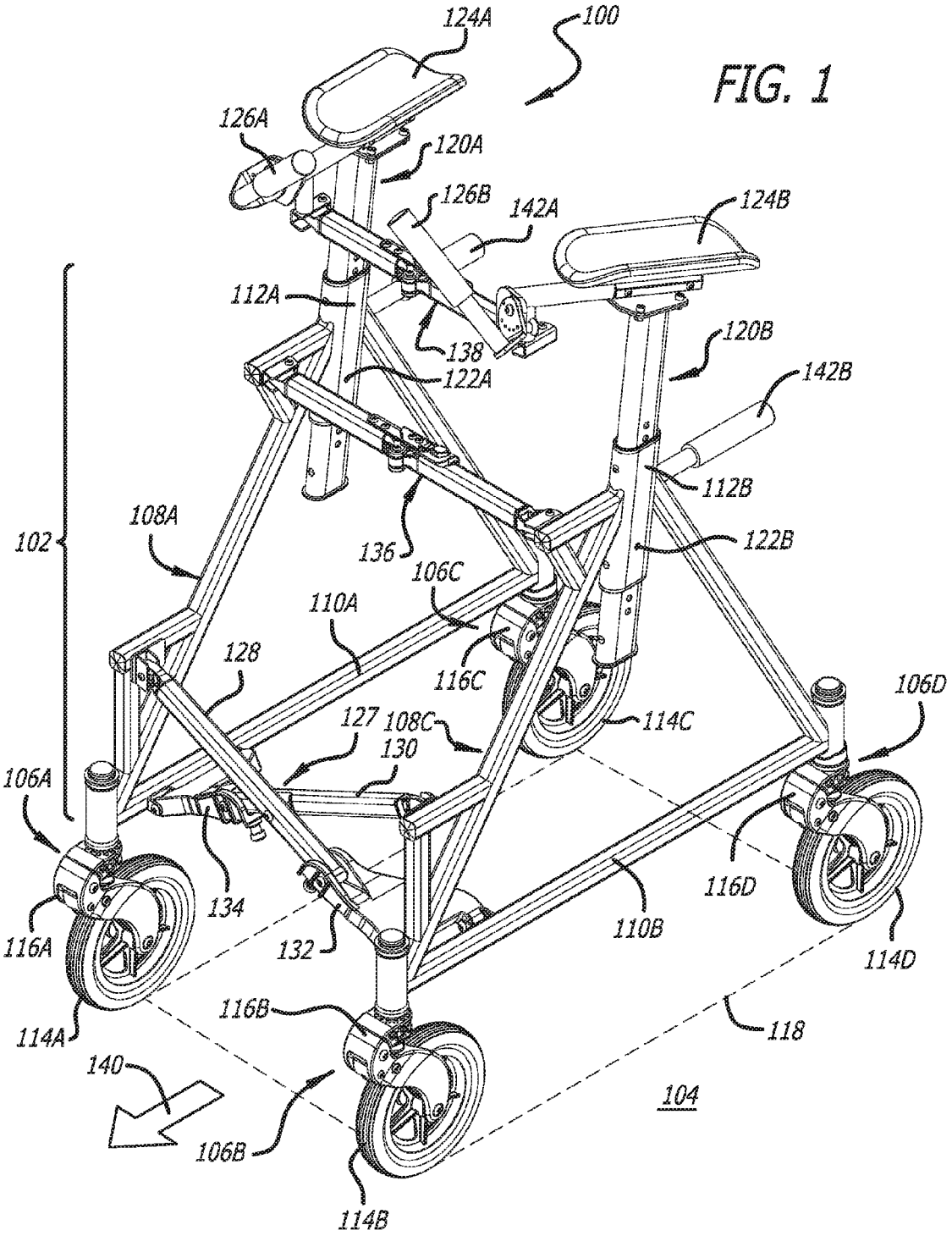
FIG. 1 is an oblique upper left front view of an exemplary embodiment of the upright wheeled walker of this invention.

FIG. 1 shows a collapsible upright wheeled walker apparatus 100 with a frame 102 supported above a walking surface 104 on four wheel assemblies 106A-D, including wheel assemblies 106A-B under a front frame portion and wheel assemblies 106C-D under a rear frame portion. Frame 102 includes the two frame sides 108A-B, each having three connected frame side support elements, including the respective elements 110A-B at the frame side bottoms and the respective element pairs each coupled to a respective upper support channel 112A-B at the top of the respective frame sides 108A-B. Wheel assemblies 106A-D each includes a respective wheel 114A-D and a respective wheel suspension assembly 116A-D that is fixed to frame 102 at the vertices of a polygonal footprint 118 on walking surface 104 and are described in connection with FIG. 5 below. Each of the two upper supports 120A-B is inserted into and slidably engaged with a respective upper support channel 112A-B. Each of two locking pins 122A-B are engaged in a respective upper support channel 112A-B and operate to lock the respective slidably engaged upper support 120A-B at a selectable elevation above walking surface 104 for a particular user height Each upper support 120A-B includes a respective forearm gutter 124A-B and a respective upper handle 126A-B, which are described in connection with FIGS. 7 and 8A-C below. FIG. 1 also shows the X-folder apparatus 127, which includes an anterior element 128 rotatably-coupled to a posterior element 130 and the anterior arm 132 and the posterior arm 134. The foldable frame bridge 136 is shown coupled between frame sides 108A-B at an exemplary elevation above walking surface 104 and the foldable support bridge 138 is shown coupled between upper supports 120A-B. X-Folder apparatus 127, foldable frame bridge 136 and foldable support bridge 138 are all useful for collapsing upright wheeled walker 100 for convenient storage and transportation (FIG. 6) and are all described in connection with FIGS. 9A-D below.

Figure 10:
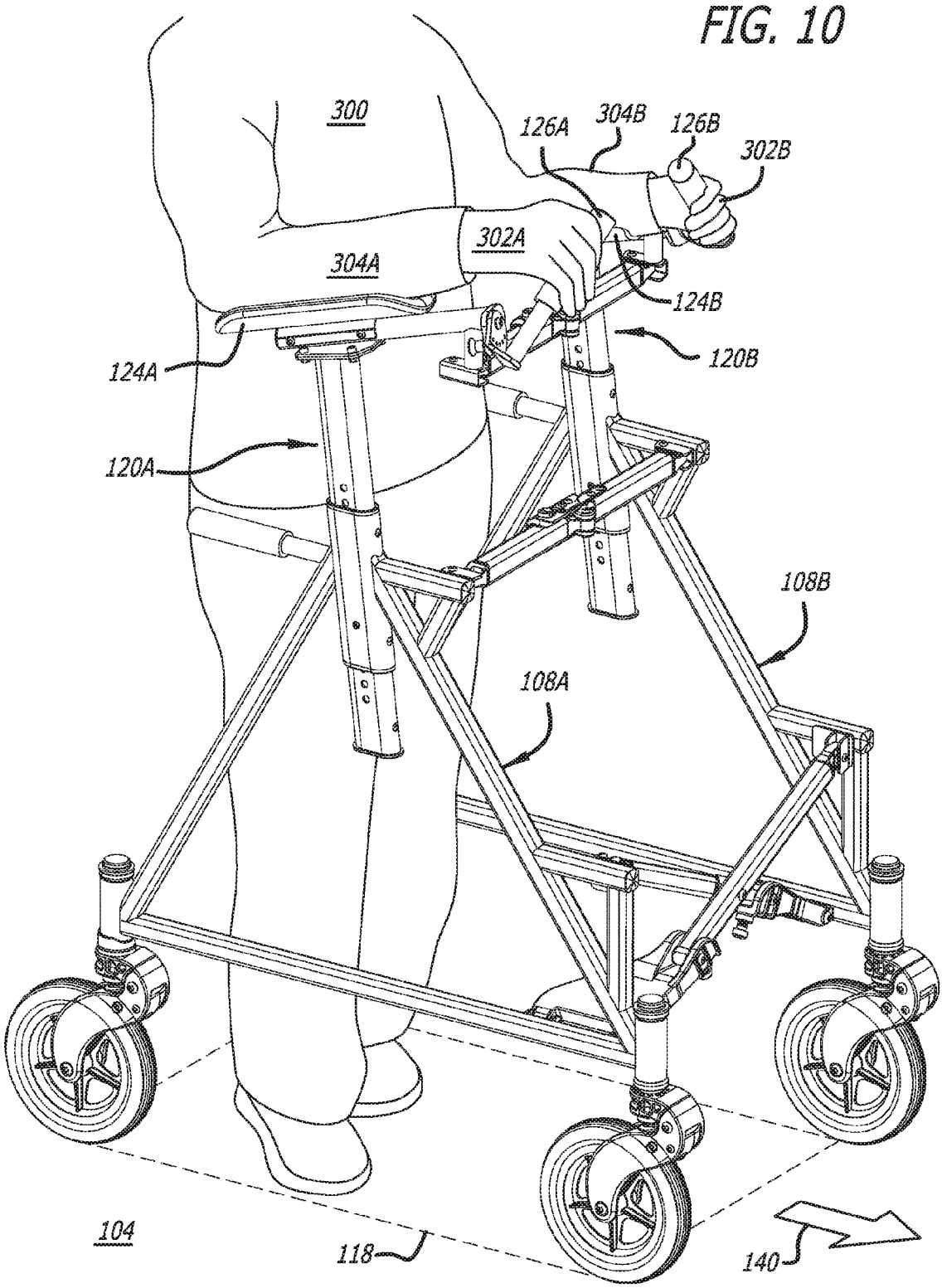
FIG. 10 is an oblique view of a user standing in a partially supported position within the polygonal footprint of the upright wheeled walker embodiment of FIG. 1.

Referring to FIG. 10, during use, after adjusting both upper supports 120A-B to a desired elevation above surface 104, a user 300 stands and steps within footprint 118 on walking surface 104 between frame sides 108A-B and grasps a respective upper handle 126A-B with each hand 302A-B while resting each forearm 304A-B in a respective armrest gutter 124A-B, thereby resting at least some upper-body weight on walker apparatus 100 while standing on walking surface 104. User 300 may then walk forward in the direction shown by the arrow 140 as walker apparatus 100 rolls over surface 104 while supporting at least some weight with armrest gutters 124A-B, reducing user leg effort and improving user stability and thereby augmenting the user's ability to step along surface 104 without the assistance of another person. Each of the lower handles 142A-B is disposed on a respective frame side 108A-B to permit user 300 to grasp lower handles 142A-B and move forward, using walker apparatus 100 only for stability without forearm support in the customary manner when desired.

While the inventors prefer an embodiment with four wheel assemblies, with adjustments to the folder and suspension elements, the apparatus of this invention may also be embodied with three wheels, by using a single front wheel assembly, or with five wheels, by adding a central front wheel assembly, for example, without affecting the other advantages and features described herein.

Figure 2:
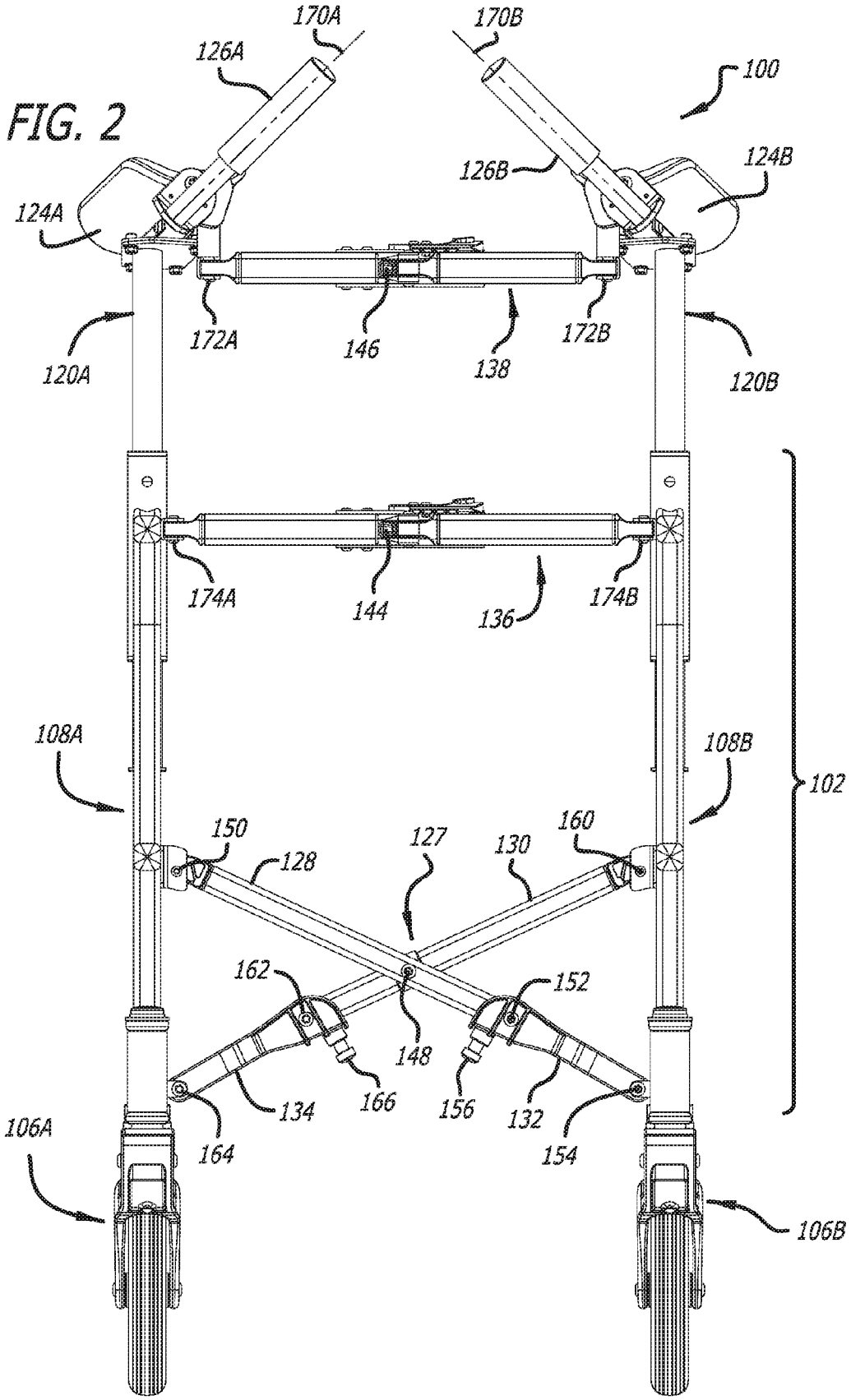
FIG. 2 is a front view of the upright wheeled walker embodiment of FIG. 1.

FIG. 2 shows a front view of walker apparatus 100 to better illustrate several components of the apparatus of this invention. Like numerals represent like features to those discussed above in connection with FIG. 1. In particular, FIG. 2 better shows the frame bridge offset hinge 144 in foldable frame bridge 136, the support bridge offset hinge 146 in foldable support bridge 138, and the X-folder hinge 148 in X-folder apparatus 127 that rotatably couples anterior element 128 to posterior element 130. Note that a first end of anterior element 128 is coupled to frame side 108A by the hinge 150 and the opposite end of anterior element 128 is rotatably coupled to anterior arm 132 at the anterior bias hinge 152. The distal end of anterior arm 132 is rotatably coupled to frame side 108B by the two hinges 154 and 155 (see FIG. 3) so the distance between hinges 150 and 154-155 can be adjusted over a small range by means of the anterior stop screw 156, which may be better appreciated with reference to the discussion of FIGS. 9A-D below. Similarly, a first end of posterior element 130 is coupled to frame side 108B by the hinge 160 and the opposite end of posterior element 130 is rotatably coupled to posterior arm 134 at the posterior bias hinge 162. The distal end of posterior arm 134 is rotatably coupled to frame side 108A by the two hinges 164 and 165 (see FIG. 3) such that the distance between hinges 160 and 164-165 can be adjusted over a small range by means of the posterior stop screw 166, which may be better appreciated with reference to the discussion of FIGS. 9A-D below. FIG. 2 also shows the upper handle centerlines 170A-B for upper handles 126A-B respectively, disposition of which may be better appreciated with reference to the description of FIGS. 7 and 8A-C below. And FIG. 2 shows the two support bridge ends 172A-B each rotatably coupled to a respective upper support 120A-B and the two frame bridge ends 174A-B each rotatably coupled to a respective upper support 120A-B.

Figure 3:
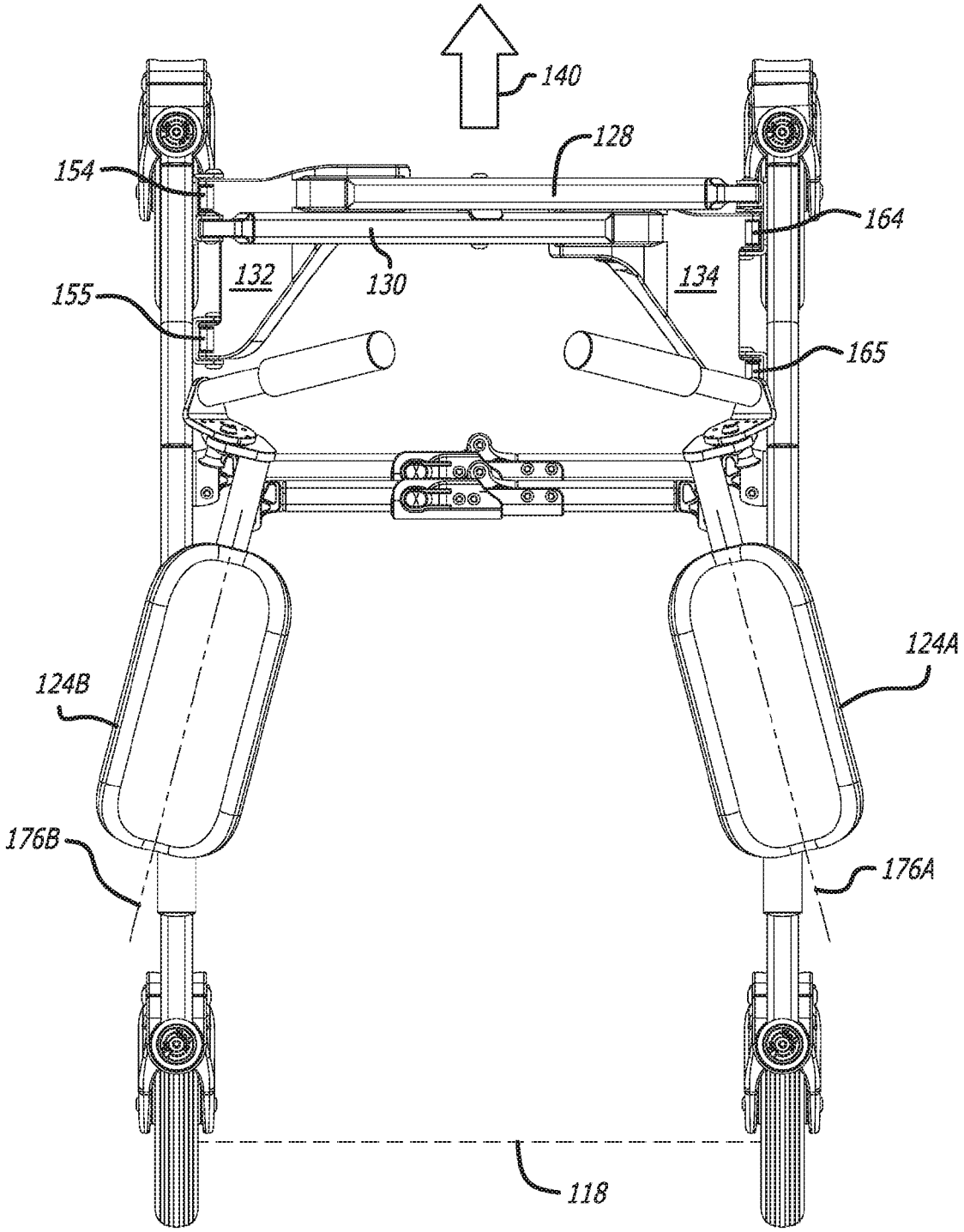
FIG. 3 is a top view of the upright wheeled walker embodiment of FIG. 1 illustrating the plan views of the polygonal footprint defined by the front and rear wheels and the upper support elements of this invention.

FIG. 3 shows a top view of walker apparatus 100 to better illustrate several components of the apparatus of this invention. Like numerals represent like features to those discussed above in connection with FIGS. 1-2. In particular, FIG. 3 shows the forearm gutter centerlines 176A-B for forearm gutters 124A-B respectively, the preferred disposition of which may be better appreciated with reference to the description of FIGS. 7 and 8A-C below. FIG. 3 better illustrates the coupling of anterior arm 132 to frame side 108B and the coupling and disposition of posterior arm 134 to frame side 108A, for example.

Figure 4:
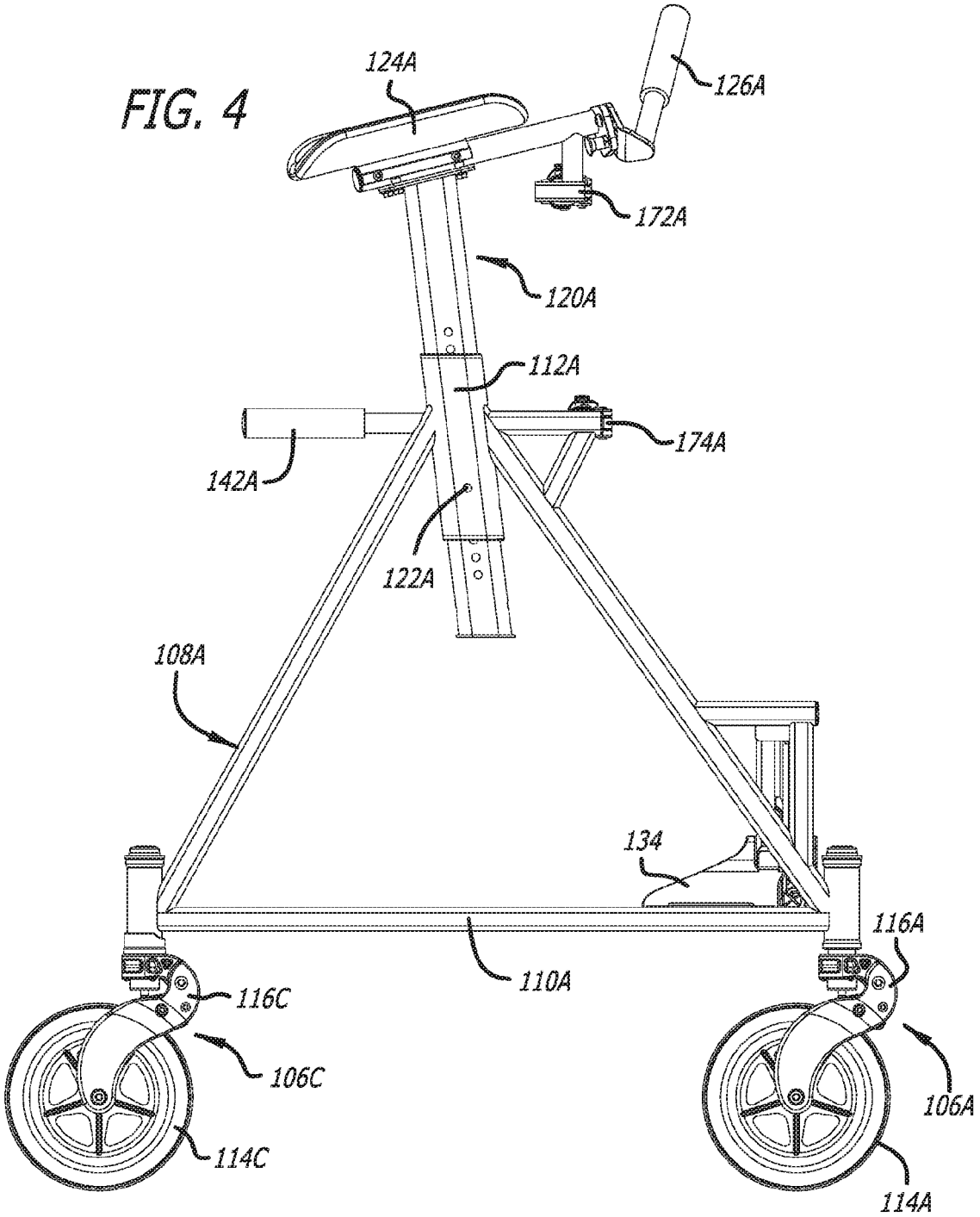
FIG. 4 is a right side view of the upright wheeled walker embodiment of FIG. 1.

FIG. 4 shows a right side view of walker apparatus 100 to better illustrate several components of the apparatus of this invention. Like numerals represent like features to those discussed above in connection with FIGS. 1-3. FIG. 4 better illustrates the exemplary embodiment of posterior arm 134 and the adjustable engagement of upper support 120A to upper support channel 112A at the top of frame side 108A, for example.

Figure 5:
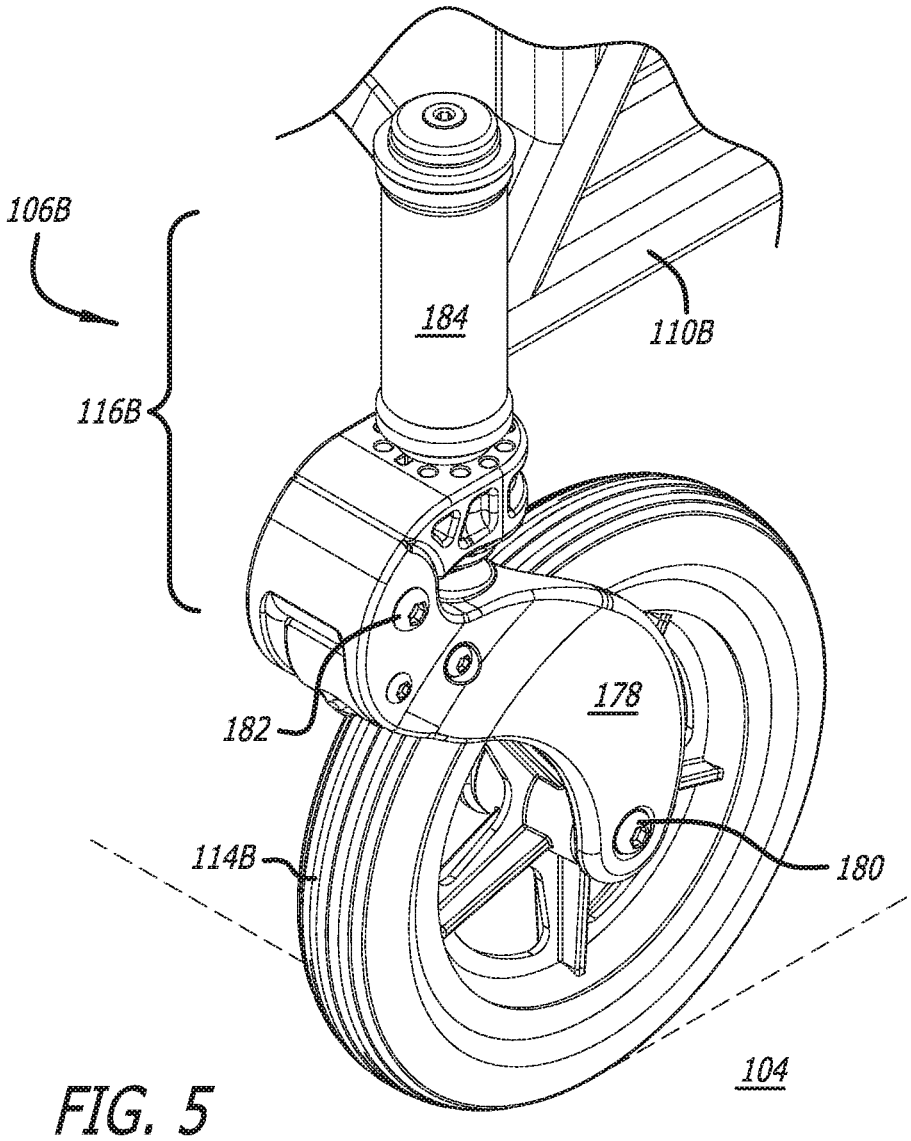
FIG. 5 is a close-up oblique view of the left front wheel assembly element of the upright wheeled walker embodiment of FIG. 1.

FIG. 5 shows wheel assembly 106B in more detail. A wheel fork assembly 178 is rotatably coupled to wheel 114B at an axle 180 and to wheel suspension assembly 116B at a hinge 182 thereby permitting displacement of frame element 110B with respect to surface 104 responsive to any rotation of wheel fork assembly 178 about hinge 182. Rotation of wheel fork assembly 134 about hinge 182 changes the elevation of frame element 110B above axle 180. A shock absorber assembly 184 is coupled between frame element 110B and wheel fork 178 to moderate the transmission of wheel motion to the frame during use. Shock absorber assembly 184 includes a shock absorber (not shown) preloaded to a predetermined load limit and described in the commonly-assigned U.S. patent application Ser. No. 15/012,784 filed on Feb. 1, 2016 and entirely incorporated herein by reference.

Figure 6:
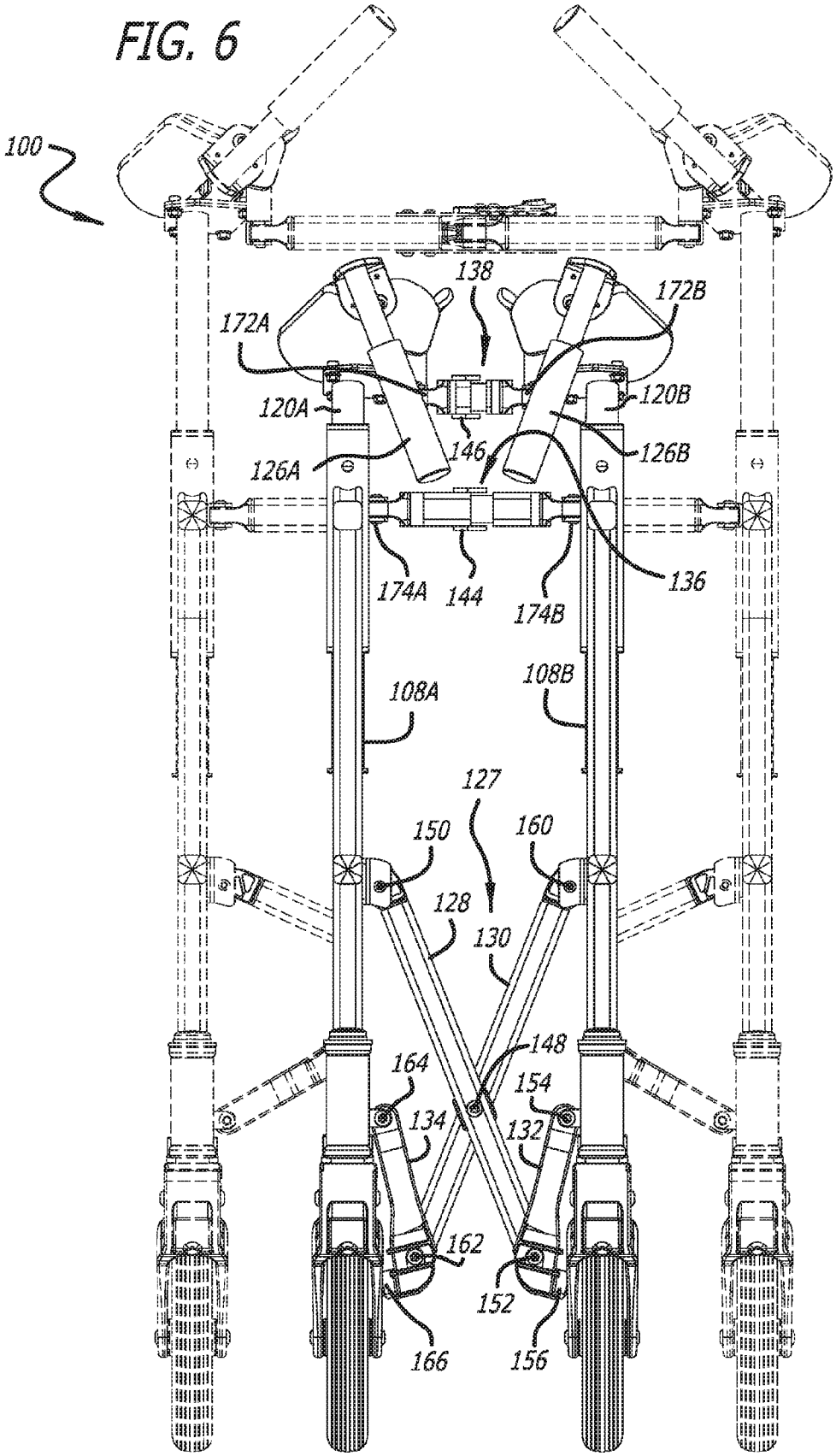
FIG. 6 is a front view of both the open and collapsed dispositions of the upright wheeled walker embodiment of FIG. 1 illustrating the operation of the X-Folder and bridge elements of this invention.

FIG. 6 illustrates the front view of FIG. 2 of walker apparatus 100 in the open configuration (dotted lines) overlaid with the same walker apparatus 100 in a collapsed configuration (solid lines) useful for transportation and storage. Walker apparatus 100 may be folded from the open configuration to the collapsed configuration by (a) rotating both upper handles 126A-B into the downward position shown, (b) releasing the locking pins 122A-B (FIGS. 1 and 4) and dropping the two upper supports 120A-B down to their lowest elevation, (c) releasing frame bridge offset hinge 144 and support bridge offset hinge 146 and initiating the folding of frame bridge 136 and support bridge 138 respectively, and (d) collapsing frame bridge 136, support bridge 138 and X-folder apparatus 127 while forcing the two frame sides 108A-B together. It may be readily appreciated from FIG. 6 that walker apparatus 100 may be returned to the open configuration for use by reversing these steps while forcing frame sides 108A-B apart and locking frame bridge offset hinge 144 and support bridge offset hinge 146 before returning upper supports 120A-B to their desired elevation and fixing them with locking pins 122A-B before returning upper handles 126A-B to their upright position shown in FIG. 2.

When folding X-folder apparatus 127, anterior element 128 rotates about X-folder hinge 148 with respect to posterior element 130 and rotation of each respective component also occurs at each of the six hinges 150, 154-155, 160 and 164-165 as may be appreciated from FIG. 6. Moreover, during such rotation, anterior arm 132 rotates about anterior bias hinge 152 at the distal end of anterior element 128 and posterior arm 134 rotates about posterior bias hinge 162 at distal end of posterior element 128. The purpose and function of anterior and posterior bias hinges 152 and 162 are described below in connection with FIGS. 9A-D.

Figure 7:
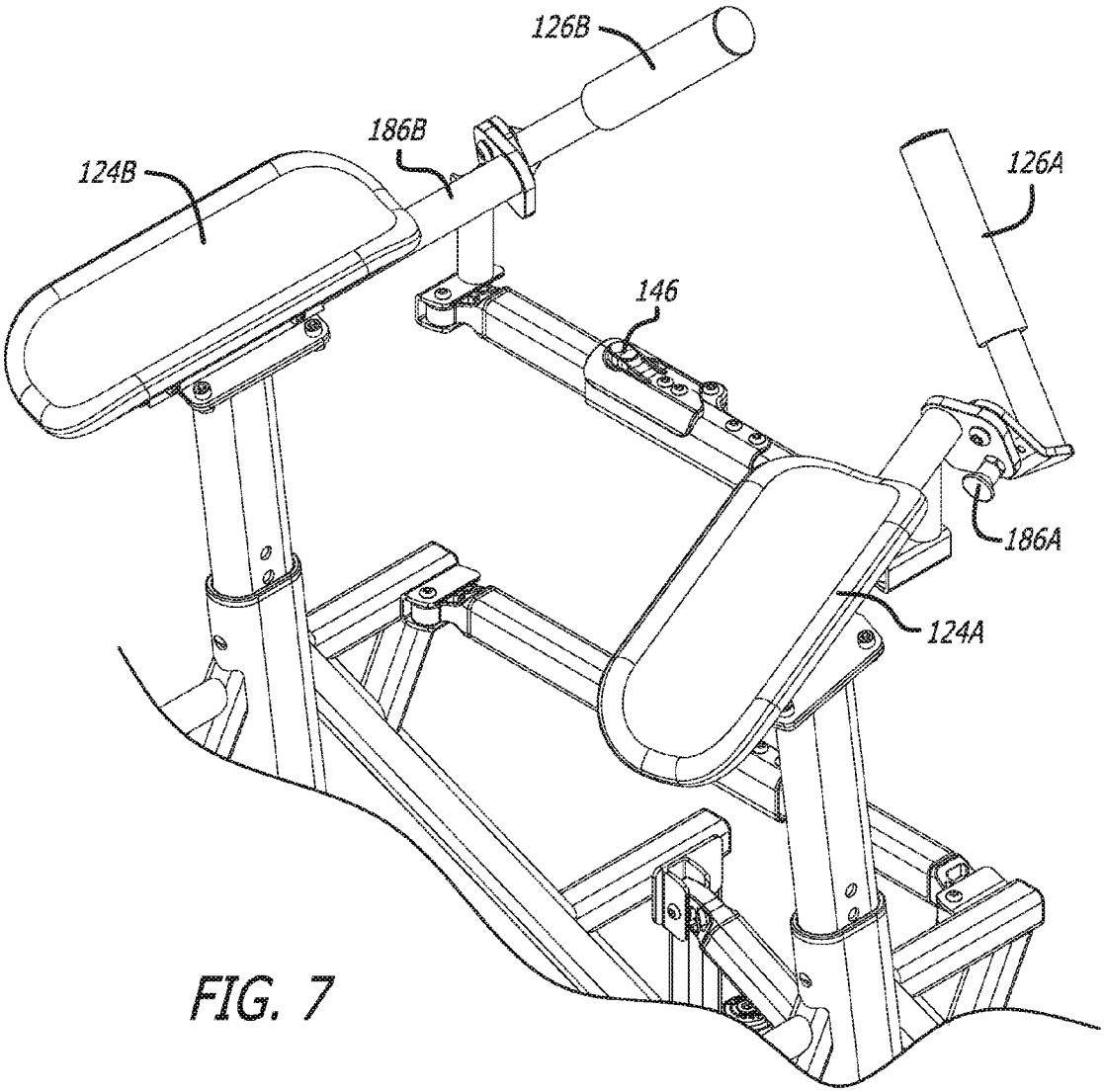
FIG. 7 is a close-up oblique upper tight rear view of the forearm gutter and upper handle elements of the upright wheeled walker embodiment of FIG. 1.

FIG. 7 provides a closer oblique view of the upper support structure of walker apparatus 100 to better illustrate the relative disposition and orientation of forearm gutters 124A-B and upper handles 126A-13, which features are now described in detail with reference to FIGS. 8A-C.

Figure 8A:
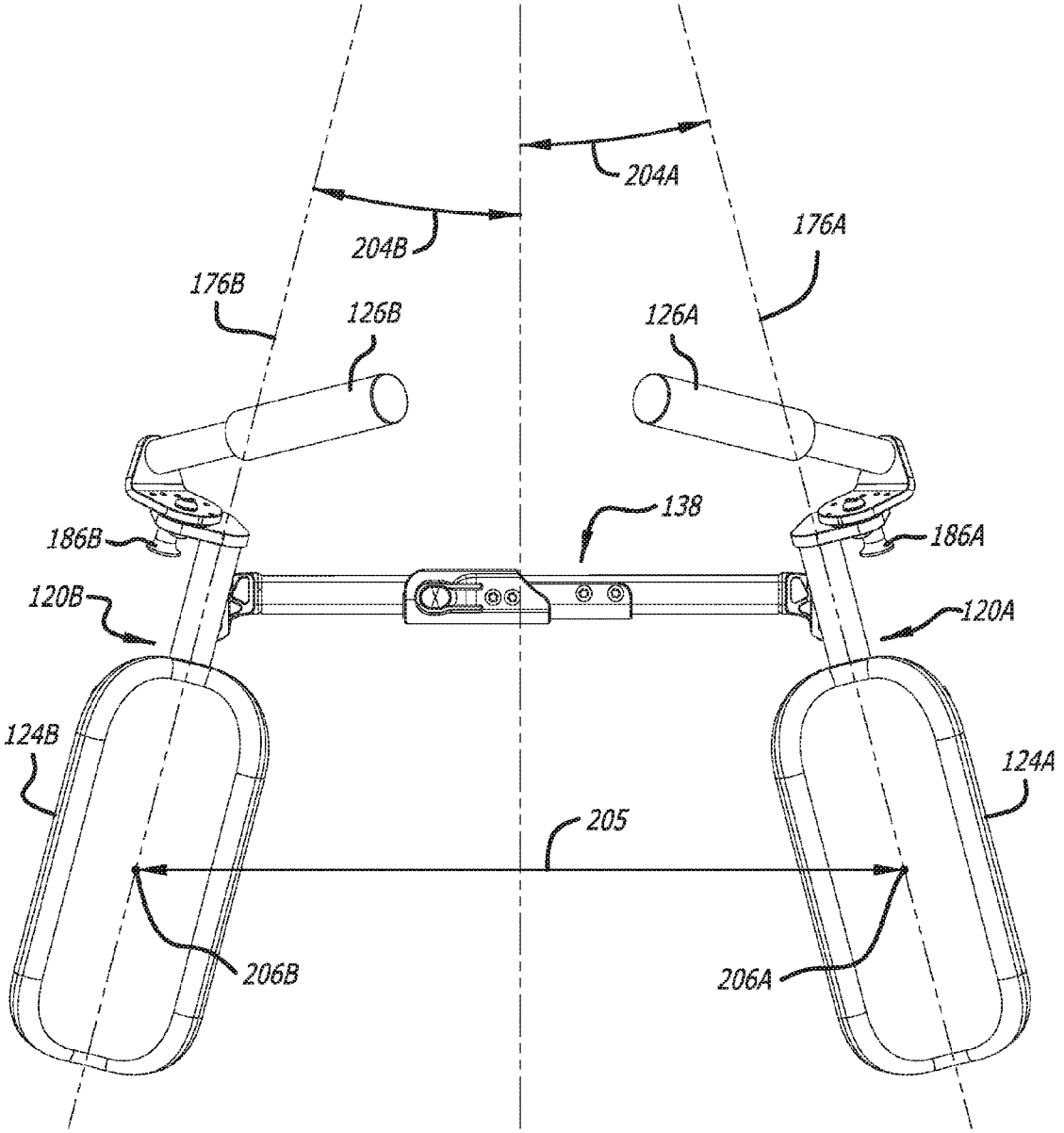
FIGS. 8A-C are diagrams illustrating the preferred orientation of the forearm gutter and upper handle elements of this invention.
Figure 8B:
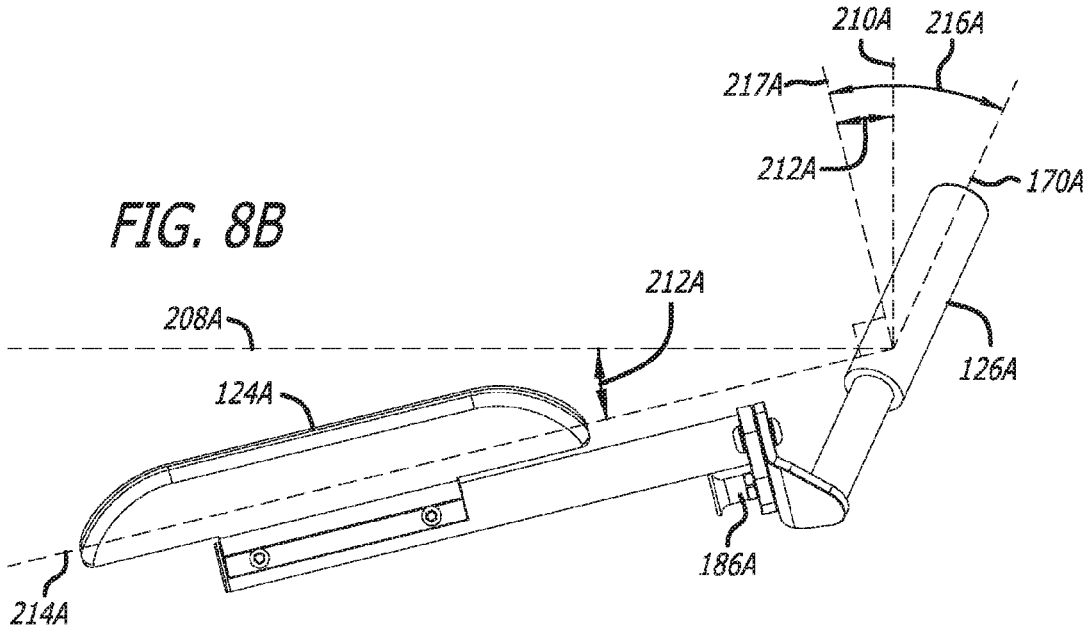
Figure 8C:
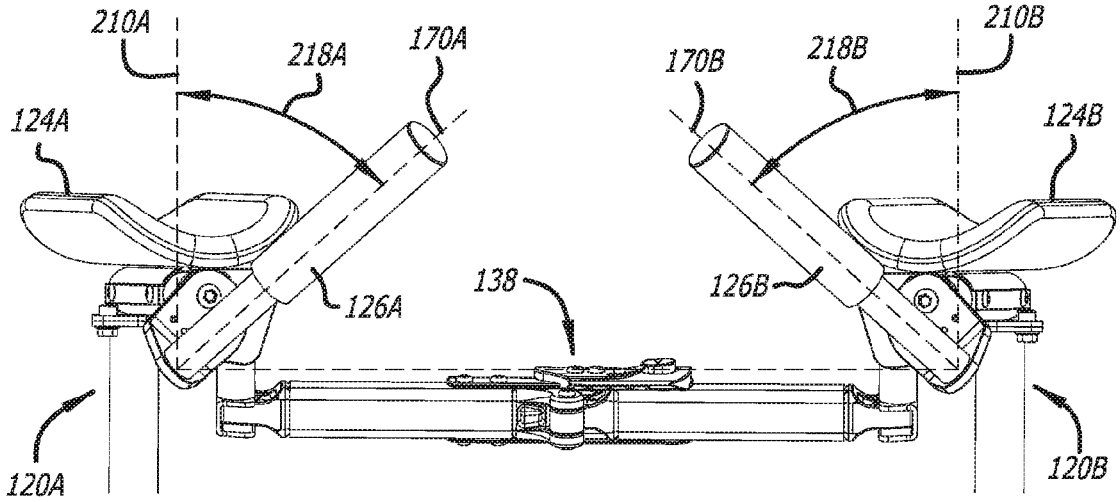

FIGS. 8A-C are diagrams illustrating the preferred disposition and orientation of forearm gutters 124A-B and upper handles 126A-B. FIG. 8A illustrates the top view of FIG. 3 with upper supports 120A-B and support bridge 138 isolated for clarity. The inventors have found that forearm gutter centerlines 176A-B are preferably aligned as shown, with the two angles 204A-B fixed at about 14 degrees and being substantially equal, which provides the optimal ergonomic support for the widest range of user sizes when fixing the gutter spacing 205 to about 18.5±1 inches between the geometric midpoints 206A-B of forearm gutters 124A-B. Angles 204A-B may be varied over a range of [0-18] degrees, but many orientations within that range would require changes to gutter spacing 205 to facilitate use by many users, who would find the reoriented forearm gutters 124A-B either too closely spaced or too widely spaced for feasible use. The inventors have discovered that a 14 degree setting for angles 204A-B is comfortable for the most users because it provides a "self-compensating" support system. This self-compensating feature may be appreciated by considering that a shorter user with shorter forearms must move her arms forward to grip upper handles 126A-B. This places her elbows forward in the "V" defined by centerlines 176A-B and places her (narrower) shoulders above a narrower position in the "V." Alternatively, consider that a taller user with broader shoulders must move his arms back to grip upper handles 126A-B. This places his elbows rearward in the "V" defined by centerlines 176A-B and places his broader shoulders above a wider position in the "V." The inventors found that this "self-compensation" permits using forearm gutters and upper handles with fixed spacing and orientation to support the majority of prospective users in comfort.

FIG. 8B is an isolated right-side view better illustrating the disposition and orientation of armrest gutter 124A and upper handle 126A with respect to walking surface 104 (FIGS. 1 and 10). Although not seen in FIG. 8B, the relative dispositions of armrest gutter 124B and upper handle 126B with respect to walking surface 104 are substantially the same as shown in FIG. 8B. The horizontal line 208A and the vertical line 210A are respectively parallel and perpendicular to walking surface 104. The inventors have discovered through testing that fixing the angle 212A between horizontal line 208A and the gutter axis 214A to a value within the range [10, 20] degrees in an upward direction from rear to front as shown is preferred. The optimal ergonomic benefits are gained with angle 212A fixed at about 14 degrees, which satisfies most people under most conditions.

Similarly, the inventors discovered through testing that the forward handle angle 216A between the gutter axis perpendicular 217A and handle centerline 170A is preferably fixed somewhere in the range of [10, 40] degrees (preferably at about 30 degrees) forward of gutter axis perpendicular 217A or equivalently at about 120 degrees (30+90) forward from the plane defined by gutter axis 214A and about 16 degrees (30−14) forward of true vertical. As seen below in connection with FIG. 8C, each forward handle angle 216A-B (216B not shown) is fixed with respect to the plane defined by a respective gutter axis 214A-B (214B not shown) but each handle 126A-B (1269 not shown) may be rotated about an axis co parallel with a respective forearm gutter centerline 176A-B. The disposition and orientation of forearm gutter 1249 and upper handle 1269 may be appreciated by analogy when referring to this discussion of FIG. 8B.

FIG. 8C is an isolated upper front oblique view better illustrating the disposition and orientation of armrest gutters 124A-B and upper handles 126A-B. Although similar to the front view of FIG. 2, FIG. 8C is a view of a plane disposed perpendicularly to the plane defined by armrest gutter axes 176A-B (FIG. 8A) and axes 214A-B (FIG. 8B). This may be appreciated by recognizing that the viewpoint of FIG. 8C is elevated above the true horizontal viewpoint of FIG. 2 by an angle equal to angle 212A (FIG. 8B). Both the vertical line 210B and vertical line 210A are perpendicular to walking surface 104 (FIGS. 1 and 10). The transverse handle angles 218A-B may be varied independently and locked in any of several orientations between vertical (zero degrees) and horizontal (90 degrees) by releasing upper handle latches 186A-B (FIG. 8A) and reorienting respective upper handles 126A-B. The inventors have found that most users preferred fixing transverse handle angles 218A-B at some value in a range of [0, 45] degrees with more preferring the larger value.

Figure 9A:
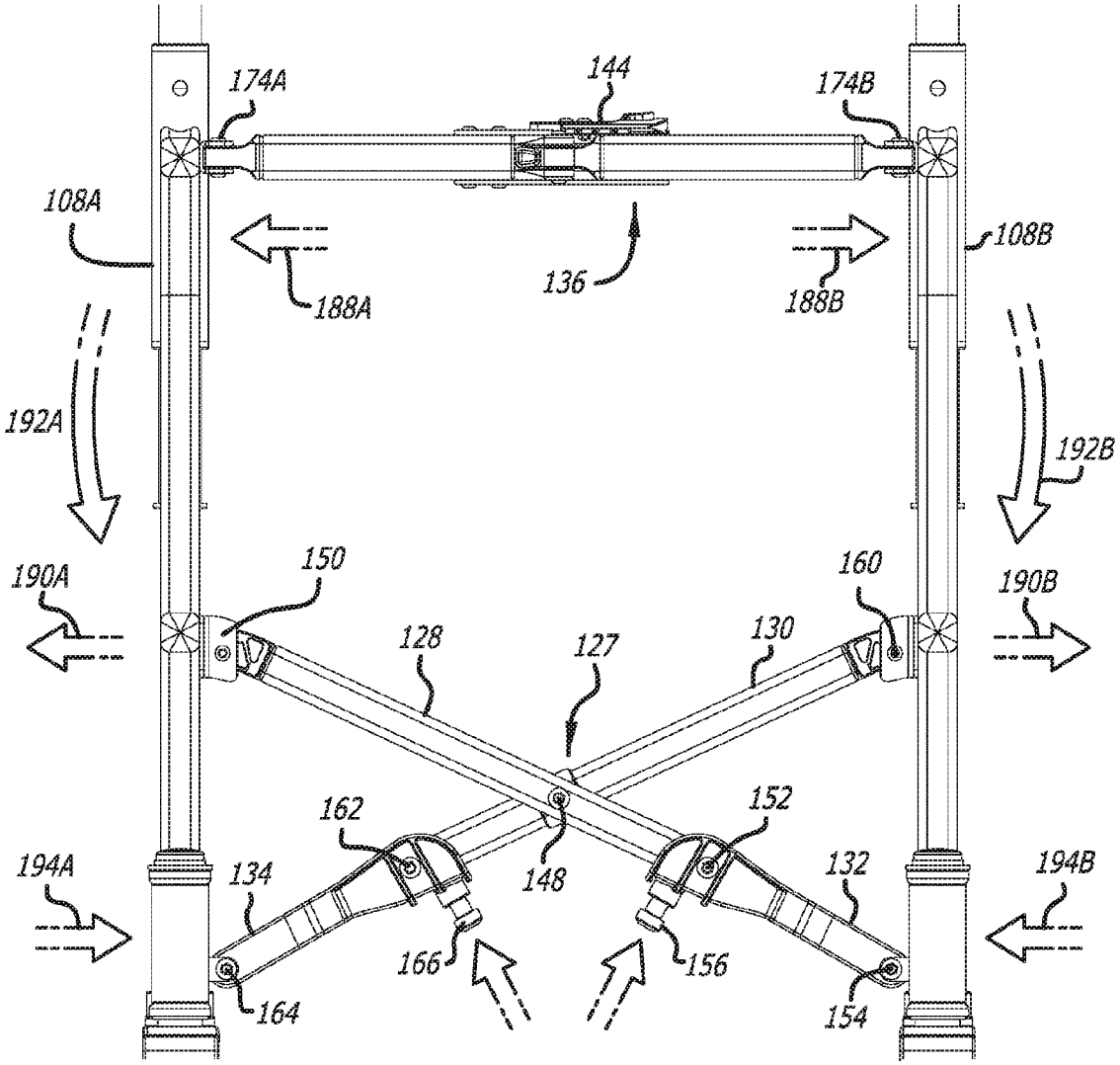
FIGS. 9A-D are detail views illustrating the several frame rigidizing X-folder and bridge elements of the upright wheeled walker embodiment of FIG. 1.

FIG. 9A illustrates the various frame-rigidizing folder elements of the apparatus of this invention. FIG. 2 shows anterior and posterior stop screws 156 and 166 in a larger context. When walker apparatus 100 is in the open configuration shown in FIGS. 2 and 9A, frame sides 108A-B are substantially parallel to one another, which permits upper supports 120A-B to rise or fall through their entire adjustment range without binding with the respective upper support channels 112A-B. When frame bridge offset hinge 144 is latched, frame bridge 136 is under longitudinal compression and urges frame sides 108A-B apart at hinges 174A-B by applying an upper spreading force represented by the arrows 188A-B to hinges 174A-B respectively. Upper spreading force 188A-B induces a lower spreading force represented by the arrows 190A-B at hinges 150 and 160 respectively. Upper and lower spreading forces 188A-B and 190A-B induce a counterclockwise torque in frame side 108A, represented by the arrow 192A and an opposing clockwise torque in frame side 108B, represented by the arrow 192, urging frame sides 108A-B (respectively) about hinges 150 and 160 and against hinges 164-165 and hinges 154-155 with a closing force represented by the arrows 194A-B. This also may be appreciated by understanding that pulling hinge 150 outward (arrow 190A) applies an inward force (arrow 194B) on the opposite hinges 154-155, because hinges 150 and hinges 154-155 are linked together by the coupled anterior element 128 and anterior arm 132. Similarly, pulling hinge 160 outward (arrow 190B) applies an inward force (arrow 194A) on the opposite hinges 164-165, because hinges 160 and 164-165 are linked together by the coupled posterior element 130 and posterior arm 134. The frame-stiffening operation of anterior and posterior stop screws 156 and 166 is now described.

Figure 9B:
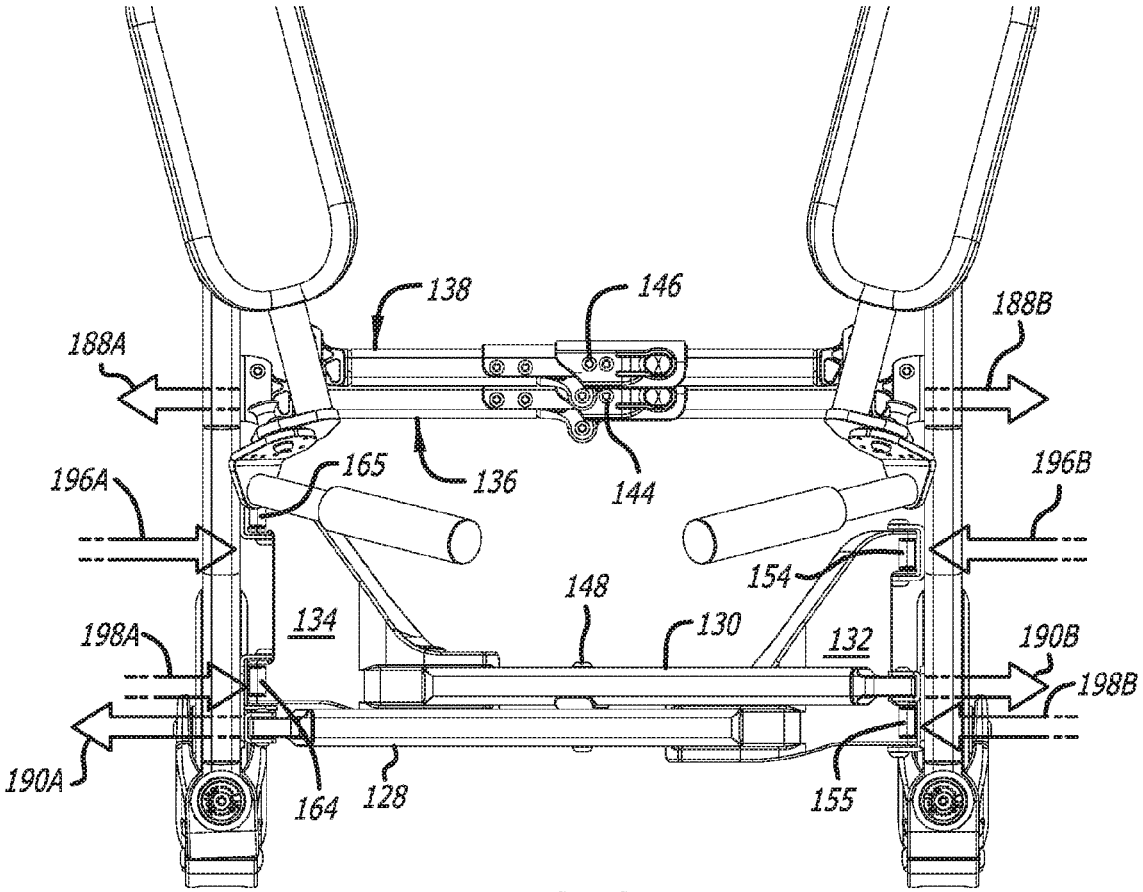

FIG. 9B is a top view that illustrates from above the upper spreading force at arrows 188A-B from frame bridge 136 and the resulting lower spreading force at the arrows 190A-B. Because frame bridge 136 is disposed behind X-folder apparatus 127 and posterior arm 134 is coupled at hinges 164 and 165, closing force 194A (FIG. 9A) is split into a rear closing force represented by the arrow 196A and a front closing force represented by the arrow 198A. Similarly, because anterior arm 132 is coupled at hinges 154 and 155, closing force 194B (FIG. 9A) is split into a rear closing force represented by the arrow 196B and a front closing force represented by the arrow 198B. It may be appreciated that front closing forces 198A-B exceed rear closing forces 196A-B because of the disposition of the upper spreading force at arrows 188A-B.

It is an important aspect of the apparatus of this invention that the upper spreading force at arrows 188A-B across the latched frame bridge 136 eliminates all play or slack at hinges 150, 160, 154-155 and 164-165 and urges frame sides 108A-B into torsion (torques 192A-B in FIG. 9A). Another important aspect is that torques 192A-B are each adjustable by means of the anterior and posterior tension adjusters, respectively, shown here embodied as adjustable stop screws 156 and 166. The inventors have discovered that imposing such an adjustable torque on each of frame sides 108A-B stiffens them against any new or transient forces applied through any one of upper supports 120A-B or wheel assemblies 106A-D that may otherwise push one of frame sides 108A-B into rotation or translation with respect to the other or into shear.

It may be appreciated from this description of FIGS. 9A-B, for example, that frame bridge 136, while nominally in compression, may be urged into tension by additional spreading forces transferred from the user weight supported by upper supports 120A-B but, in this embodiment, such loading has little effect on frame stability because posterior and anterior arms 132 and 134 are both locked over center by upper spreading forces 188A-B at frame bridge 136. Support bridge 138 has a stiffening effect similar to that discussed above for frame bridge 136, which stabilizes upper supports 120A-B with respect to one another by linking them together and taking up any play between the interior surfaces of upper support channels 112A-B and the respective upper support 120A-B.

Figure 9C:
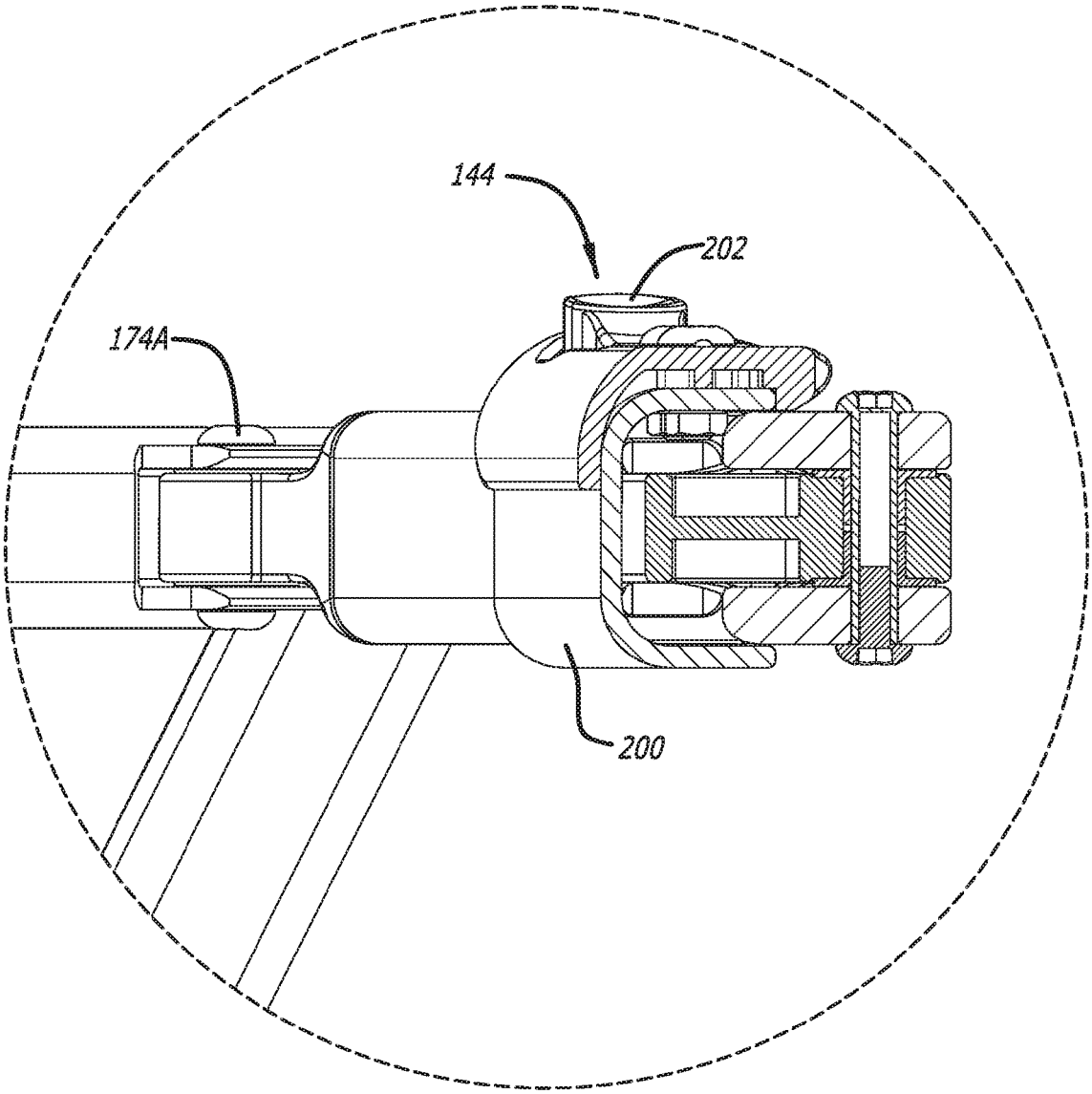

FIG. 9C provides a cross-sectional view of offset hinge 144 (FIG. 9B) showing the U-shaped member. Both frame bridge 136 and support bridge 138 are foldable at a respective offset hinge 144 and 146 that locks over center in compression, both functioning in the same manner. U-shaped member 200 functions to limit travel and thereby reduce loading of the bridge hinge latch 202.

Figure 9D:
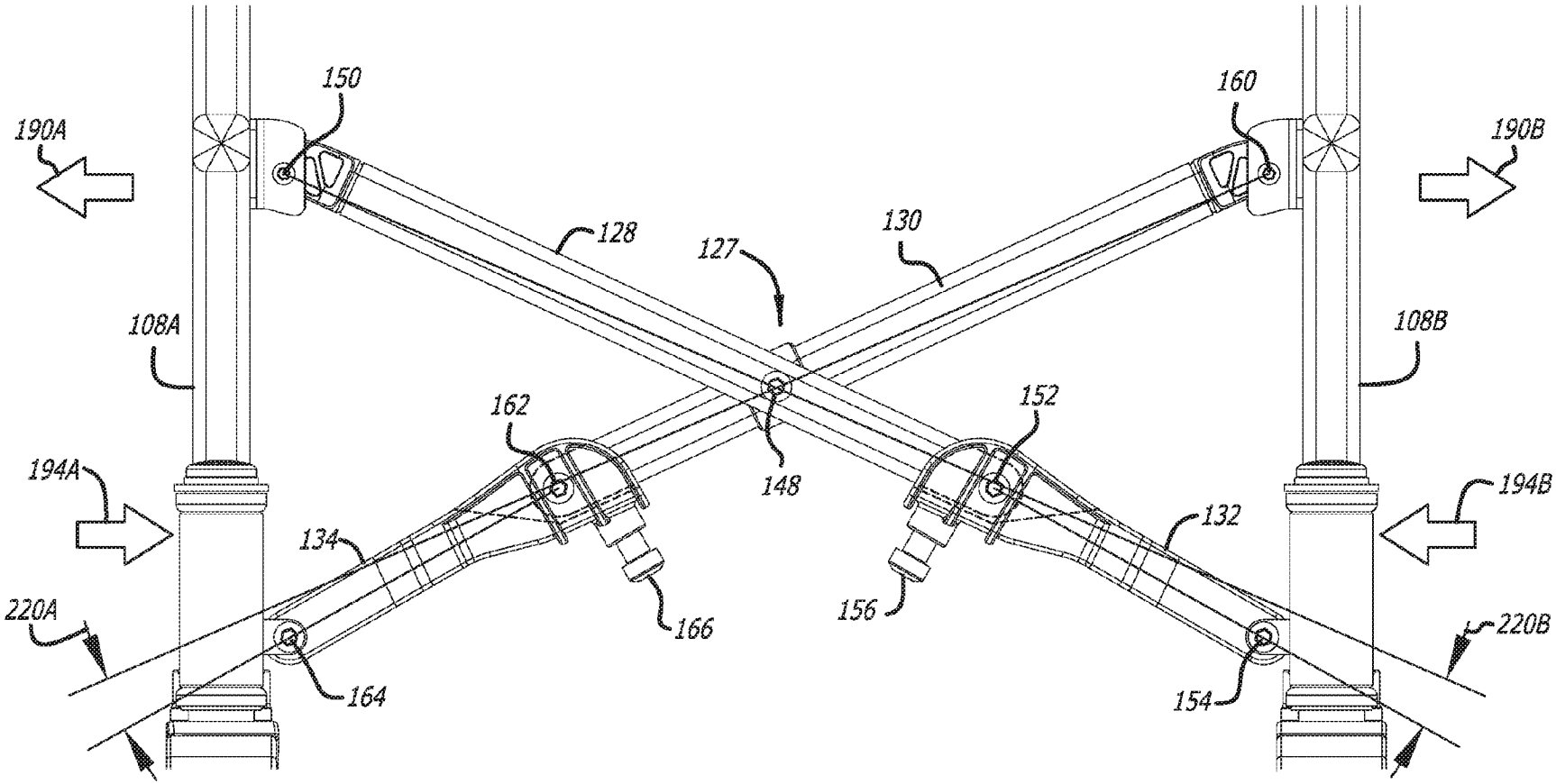

FIG. 9D provides an X-ray view of the detailed orientation and disposition of the several elements of X-folder apparatus 127 illustrating the function of the tension adjuster elements of this invention. When frame sides 108A-B are disposed substantially parallel to one another, anterior and posterior arms 132-134 are each restrained at a substantially 5.55 degree angle (the arrows 220A-B) over the center defined by the respective anterior and posterior elements 128 and 130. Increasing the inward forces 194A-B (FIG. 9A) at hinges 154 and 164 urges the over-center angles 220A-B above 5.55 degrees.

The anterior and posterior tension adjusters are embodied as stop screws 156 and 166, respectively, abutting the lower ends of the anterior and posterior elements 128 and 130 to limit travel and control the tensions imposed to stabilize frame 102 (FIG. 1). Frame tension is adjusted by screwing in stop screws 156 and 166 until contacting anterior and posterior elements 128 and 130 respectively, with frame bridge offset hinge 144 (FIG. 9A) unlatched. Stop screws 156 and 166 are each then turned inward by about ¾ turn to impose a tension that urges a reduction in the respective over-center angle 220A-B to less than the nominal 5.55 degrees. Urging such reduction attempts to increase the effective length of the anterior element-arm combination (128 plus 132) and/or the posterior element-arm combination (130 plus 134), thereby pre-loading frame sides 108A-B to stabilize and stiffen frame 102 in the open configuration (FIGS. 1-4, 6 and 10).

These elements are useful for pre-tensioning the walker frame of this invention. Once adjusted for adequate frame stabilization tension, and verified by forcing frame sides 108A-B together and apart by means of lower handles 142A-B, a thread locking agent (Loctite® 290 or equivalent) may be applied to stop screws 156 and 166. This frame pre-tensioning feature of the walker apparatus of this invention also allow a wider tolerance for component length variation, which reduces fabrication costs.

Clearly, other embodiments and modifications of this invention may occur readily to those of ordinary skill in the art in view of these teachings. Therefore, this invention is to be limited only by the following claims, which include all such embodiments and modifications when viewed in conjunction with the above specification and accompanying drawing.

The invention claimed is:

1. A collapsible upright wheeled walker apparatus for augmenting an upright partially-supported walking gait on a walking surface for an unassisted user having one or more hands and forearms, the apparatus comprising:
- a frame having two frame sides each having a top and a bottom and each frame side being disposed between a front frame portion and a rear frame portion;
- a plurality of wheel assemblies coupled to the frame for supporting the frame above the walking surface and disposed at the vertices of a polygonal footprint on the walking surface within which the user walks during use;
- an X-folder apparatus including an anterior element having two ends and a posterior element having two ends, wherein
  - the anterior element is rotatably coupled to the posterior element,
  - a first anterior element end is coupled to a first frame side and the second anterior element end is rotatably coupled to an anterior arm having a distal end that is coupled to the second frame side such that rotation of the anterior element in one direction with respect to the anterior arm is limited to an anterior over-center angle, and
  - a first posterior element end is coupled to the second frame side and the second posterior element end is rotatably coupled to a posterior arm having a distal end that is coupled to the first frame side such that rotation of the posterior element in one direction with respect to the posterior arm is limited to a posterior over-center angle;
- two upper supports each coupled to and disposed at an adjustable height above a respective frame side;
- two forearm gutters each coupled to a respective upper support for engaging and supporting one user forearm during use, wherein each forearm gutter has a centerline disposed at a first gutter angle with respect to the walking surface and at a second gutter angle with respect to the other forearm gutter centerline;
- two upper handles each coupled to a respective upper support anterior to the respective armrest gutter for gripping by one user hand, wherein each upper handle has a centerline disposed at a forward handle angle with respect to the respective forearm gutter centerline; and
- in the X-folder apparatus,
  - an anterior tension adjuster for changing the anterior over-center angle; and
  - a posterior tension adjuster for changing the posterior over-center angle.

2. The apparatus of claim 1 further comprising:
- a foldable frame bridge with two ends each rotatably coupled to a respective frame side.

3. The apparatus of claim 2 further comprising:
- a foldable support bridge with two ends each rotatably coupled to a respective upper support.

4. The apparatus of claim 3 wherein:
- the anterior and posterior over-center angles each have a value within the range of substantially [1, 10] degrees.

5. The apparatus of claim 4 further comprising:

in each wheel assembly, a rotatably-coupled wheel and a shock absorber assembly coupled between the wheel and the frame for dampening transmission of wheel motion to the frame.

6. The apparatus of claim 5 further comprising:

in each shock absorber assembly, a shock absorber disposed between two ends, one shock absorber end being coupled to the frame and the other shock absorber end being coupled to the wheel, and the shock absorber being pre-loaded to a predetermined load limit.

7. The apparatus of claim 5 further comprising:

in each frame side, three support elements coupled together at to form a triangle.

* * * * *